US008389833B2

(12) United States Patent
Muramatsu et al.

(10) Patent No.: US 8,389,833 B2
(45) Date of Patent: Mar. 5, 2013

(54) UPRIGHT PIANO TYPE ACTION

(75) Inventors: Shigeru Muramatsu, Mori-machi (JP); Hisashi Takeyama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 21 days.

(21) Appl. No.: 13/048,805

(22) Filed: Mar. 15, 2011

(65) Prior Publication Data

US 2011/0232456 A1 Sep. 29, 2011

(30) Foreign Application Priority Data

Mar. 25, 2010 (JP) ..... 2010-70531

(51) Int. Cl.
*G10C 3/18* (2006.01)

(52) U.S. Cl. ..... 84/240

(58) Field of Classification Search ..... 84/240, 84/243

See application file for complete search history.

(56) References Cited

U.S. PATENT DOCUMENTS

| | | | | | |
|---|---|---|---|---|---|
| 179,029 | A | | 6/1876 | Koth | |
| 896,763 | A | | 8/1908 | Schimmel | |
| 2,469,568 | A | * | 5/1949 | Miessner | 84/240 |
| 3,435,720 | A | * | 4/1969 | Eaton | 84/240 |
| 4,119,008 | A | * | 10/1978 | Kimble | 84/242 |
| 4,854,211 | A | | 8/1989 | Tanaka et al. | |
| 4,879,939 | A | * | 11/1989 | Wall | 84/240 |
| 5,022,302 | A | * | 6/1991 | Guyon | 84/255 |
| 5,042,354 | A | | 8/1991 | Trivelas et al. | |
| 5,509,340 | A | * | 4/1996 | Kawamura | 84/236 |
| 5,679,914 | A | * | 10/1997 | Niitsuma | 84/687 |
| 5,866,831 | A | * | 2/1999 | Kimble | 84/439 |
| 5,880,389 | A | * | 3/1999 | Muramatsu | 84/615 |
| 6,054,641 | A | * | 4/2000 | Inoue | 84/171 |
| 6,248,943 | B1 | * | 6/2001 | Inoue | 84/423 R |
| 6,777,605 | B2 | * | 8/2004 | Wenjun | 84/423 R |
| 6,965,070 | B2 | * | 11/2005 | Wenjun | 84/719 |
| 7,208,668 | B2 | * | 4/2007 | Shimoda | 84/434 |
| 8,294,009 | B2 | * | 10/2012 | Muramatsu et al. | 84/240 |
| 2005/0204890 | A1 | * | 9/2005 | Wroblewski | 84/236 |
| 2005/0284279 | A1 | * | 12/2005 | Wroblewski | 84/239 |

(Continued)

FOREIGN PATENT DOCUMENTS

| | | | |
|---|---|---|---|
| CH | 212871 | A | 12/1940 |
| CN | 270037 | Y | 4/2006 |

(Continued)

OTHER PUBLICATIONS

European Search Report mailed Jun. 11, 2012, for EP Patent Application No. 11157408.3, eight pages.

(Continued)

*Primary Examiner* — David Warren
*Assistant Examiner* — Robert W Horn
(74) *Attorney, Agent, or Firm* — Morrison & Foerster LLP

(57) ABSTRACT

An upright piano type action has a wippen 30, a jack 40, a butt 5, a swinging shank (hammer shank 71), a swinging member (hammer 70), a catcher shank 53, a backcheck 60 and a catcher 52. To any of the moving members, namely the butt 5, the swinging shank (hammer shank 71), the swinging member (hammer 70), the catcher 52 and the catcher shank 53, a weight 110, 120, 130 or 140 is attached. The weights 110, 120, 130, 140 are placed to apply loads, respectively, in a state where a key is not being depressed, in a direction opposite to a direction in which the moving members swing for hitting.

10 Claims, 8 Drawing Sheets

U.S. PATENT DOCUMENTS

| | | | | |
|---|---|---|---|---|
| 2010/0192748 | A1 * | 8/2010 | Inoue | 84/240 |
| 2011/0232456 | A1 * | 9/2011 | Muramatsu et al. | 84/241 |

FOREIGN PATENT DOCUMENTS

| | | | |
|---|---|---|---|
| DE | 691 276 | C | 5/1940 |
| DE | 1 946 970 | A1 | 5/1971 |
| EP | 0 563 771 | A2 | 10/1993 |
| EP | 0 563 771 | A3 | 10/1993 |
| FR | 528 908 | A | 11/1921 |
| GB | 2 331 831 | A | 6/1999 |
| JP | 62-043349 | Y2 | 11/1987 |
| JP | 2002041028 | A * | 2/2002 |
| JP | 2003-066950 | A | 3/2003 |
| JP | 2006-243294 | A | 9/2006 |

OTHER PUBLICATIONS

Chinese Office Action mailed Aug. 31, 2012, for CN Application No. 201110073306.6, with English Translation, 12 pages.

* cited by examiner

UPRIGHT PIANO TYPE ACTION

BACKGROUND OF THE INVENTION

1. Field of the Invention

The present invention relates to an upright piano type action including an action for an upright piano and an action of the same type as the action for an upright piano.

2. Description of the Related Art

On the market, there are a multiplicity of electronic keyboard musical instruments which generate musical tones that are close to those of a piano (acoustic piano). In many cases, such electronic keyboard instruments are used as a substitute for a piano. By improvements made to the electronic keyboard instruments for better sound quality, musical tones generated by the electronic keyboard instruments are quite close to those of pianos. As a result, not only the sound quality but also an action which is close to that of a piano is demanded of electronic keyboard instruments.

As for action of piano, there are differences in functions and touch between grand pianos and upright pianos. Generally speaking, the mass of a swing member such as a hammer acts mainly as a static load when the force with which a key is depressed is small. When the force with which the key is depressed is great, however, the mass acts largely as a dynamic load, for the acceleration of the swing member increases.

In a case of an action of a grand piano, more specifically, it is respective loads of a hammer shank, a hammer and a hammer roller that act on a jack in response to a depression of a key. Furthermore, the entire action of the grand piano is light, whereas the action is designed such that the hammer is raised from a position at which the hammer is nearly horizontal with respect to a swing fulcrum to hit a string. Therefore, the action of the grand piano has a good balance between static load and dynamic load, allowing a player to clearly perceive resistance to a weak depression of a key, and preferably increasing dynamic resistance with an increase in the strength of depression of the key. That is, the action of the grand piano allows the player to perceive the touch which is rich in the feeling of mass.

In a case of an action of an upright piano, on the other hand, it is respective loads of a wippen, a butt, a hammer shank, a hammer, a catcher shank, a catcher and the like that act on a jack in response to a depression of a key as described in Japanese examined utility model publication No. 62-43349, for example. In order to prevent the total weight of these members from becoming excessively heavy, therefore, respective masses of these swing members have to be kept small. In addition, the action of the upright piano is designed such that the hammer swings in a range in which the hammer keeps almost upright to hit a string. In spite of the static load, as a result, the action of the upright piano fails to apply an adequately increased dynamic load in response to a strong depression of a key. Therefore, the action of the upright piano offers light dynamic resistance to a key-depression, providing the player with touch which is poor in the feeling of mass.

As described above, a grand piano type action is preferable as a piano action for an electronic keyboard instrument in view of player's touch. However, the grand piano type action is not suitable for an electronic keyboard instrument which is compact in size, for the grand piano type action is large in the front-to-back direction. For such a compact electronic keyboard instrument, therefore, an upright piano type action is employed.

If an action for an upright piano which provides the player with touch which is as rich in the feeling of mass as that of a grand piano is available, the quality of the upright piano will improve significantly. Therefore, an action providing such touch has been demanded of upright pianos.

SUMMARY OF THE INVENTION

As described above, improvements in the touch have been demanded for both electronic keyboard instruments and upright pianos. Therefore, an object of the present invention is to provide an upright piano type action which realizes the touch which is as rich in the feeling of mass as the action of a grand piano.

In order to achieve the above-described object, the present invention provides an upright piano type action comprising a wippen which moves upward and downward in response to a depression and a release of a key; a jack which is supported by the wippen so as to swing; a butt which is raised by the jack to swing; a swinging shank which extends from the butt; a swinging member which is supported by an edge of the swinging shank to perform a hitting activity in accordance with a swing of the butt; a catcher shank which extends from the butt, a catcher which is supported by an edge of the catcher shank such that the catcher is received by a backcheck at the time of recovery from the hitting, and a weight attached to a moving member, the moving member being at least any one of the butt, the swinging shank, the swinging member, the catcher, and the catcher shank, wherein the weight is placed such that, in a state where the key is not being depressed, a load of the weight acts in a direction opposite to a direction in which the moving member to which the weight is attached swings for hitting.

On the upright piano type action, in the present invention, the weight which applies a load in the direction opposite to the swinging direction for hitting when a key is not depressed is attached to any of the moving members, namely the butt, the swinging shank, the swinging member, the catcher and the catcher shank. Because of the attachment of the weight, the weight produces an inertial resistance in response to a swing of the moving member caused by a depression of the key, allowing a player to perceive a touch having a dynamic weight.

Because of the swinging shank or the catcher shank having certain length, these moving members are placed at respective positions which are far from a swing fulcrum of the butt, resulting in wide areas in which the moving members swing, respectively, in response to a depression of the key. Thus, the attachment of the weight to such a member having a wide swinging area enables production of a great inertial force with a small amount of mass. Without necessity of a significant increase in static load of the weight, therefore, the action can produce a great dynamic load to allow the player to perceive the touch which is rich in the feeling of mass. Particularly, it is quite advantageous for the upright piano type action which is designed to have a multiplicity of parts provided densely in a small area to efficiently produce an inertial force with a small amount of mass.

The upright piano type action may be designed such that a swing-urging member for applying an urging force which acts in the swinging direction for hitting is coupled to either the butt or a swinging member which swings in synchronization with the butt. The weight not only acts as a dynamic load at the time of depression of a key but also increases static load. The coupling of the swing-urging member for applying an urging force which acts in the swinging direction for hitting to either the butt or the swinging member which swings in synchronization with the butt can reduce the increase in the static load without impairing the action of the dynamic load, providing the player with better touch.

As described above, the present invention provides the upright piano type action that realizes the touch which is as rich in the feeling of mass as that of grand pianos.

DESCRIPTION OF THE PREFERRED EMBODIMENT

Embodiments of the present invention will now be described with reference to the drawings. Hereafter, in regard to a piano and an action, the direction which is closer to a player will be referred to as the "front", whereas the direction which is farther from the player will be referred to as the "rear".

Figure 1:
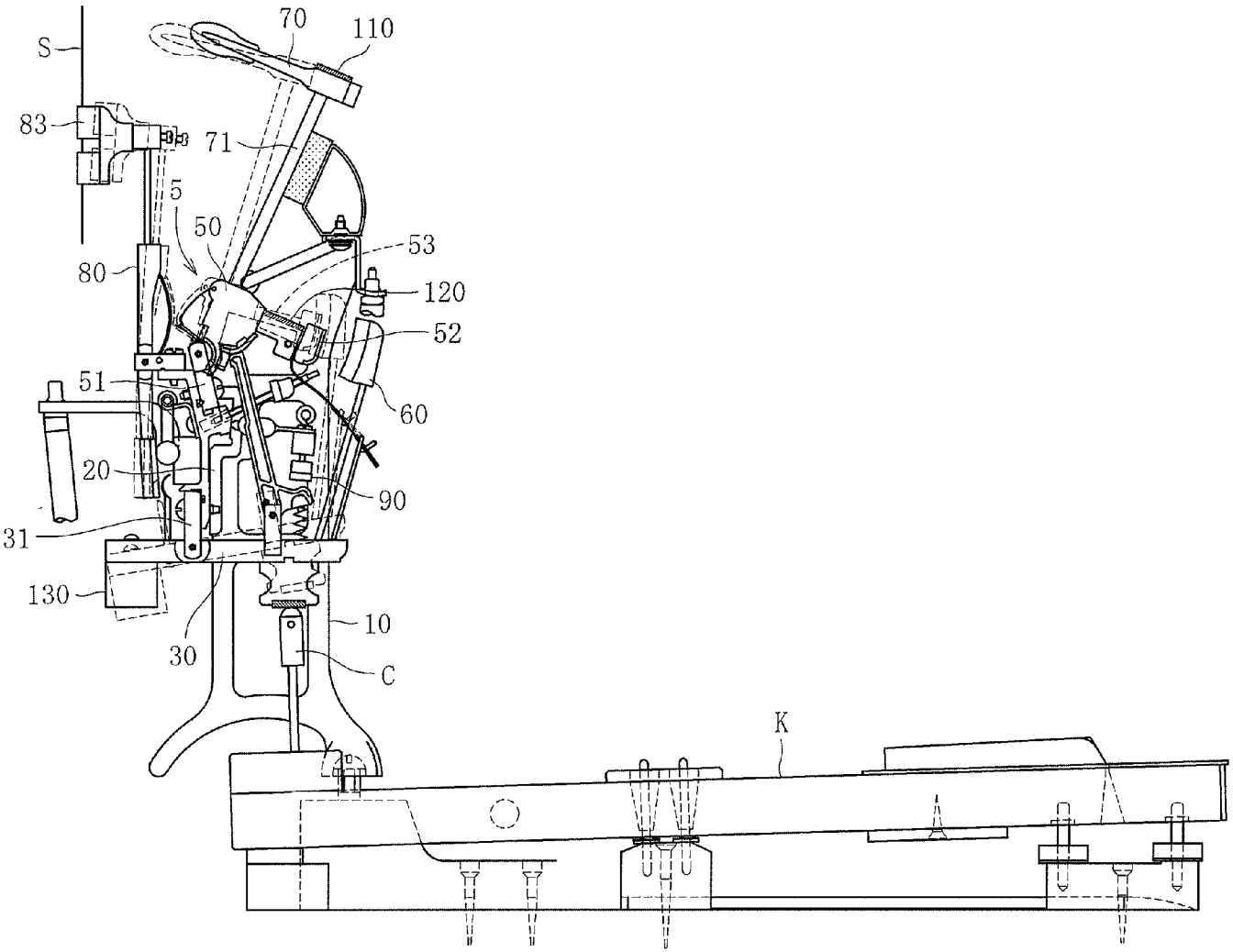
FIG. 1 is a side view indicative of a longitudinal section of an upright piano type action of an embodiment according to the present invention along with a keyboard.
Figure 2:
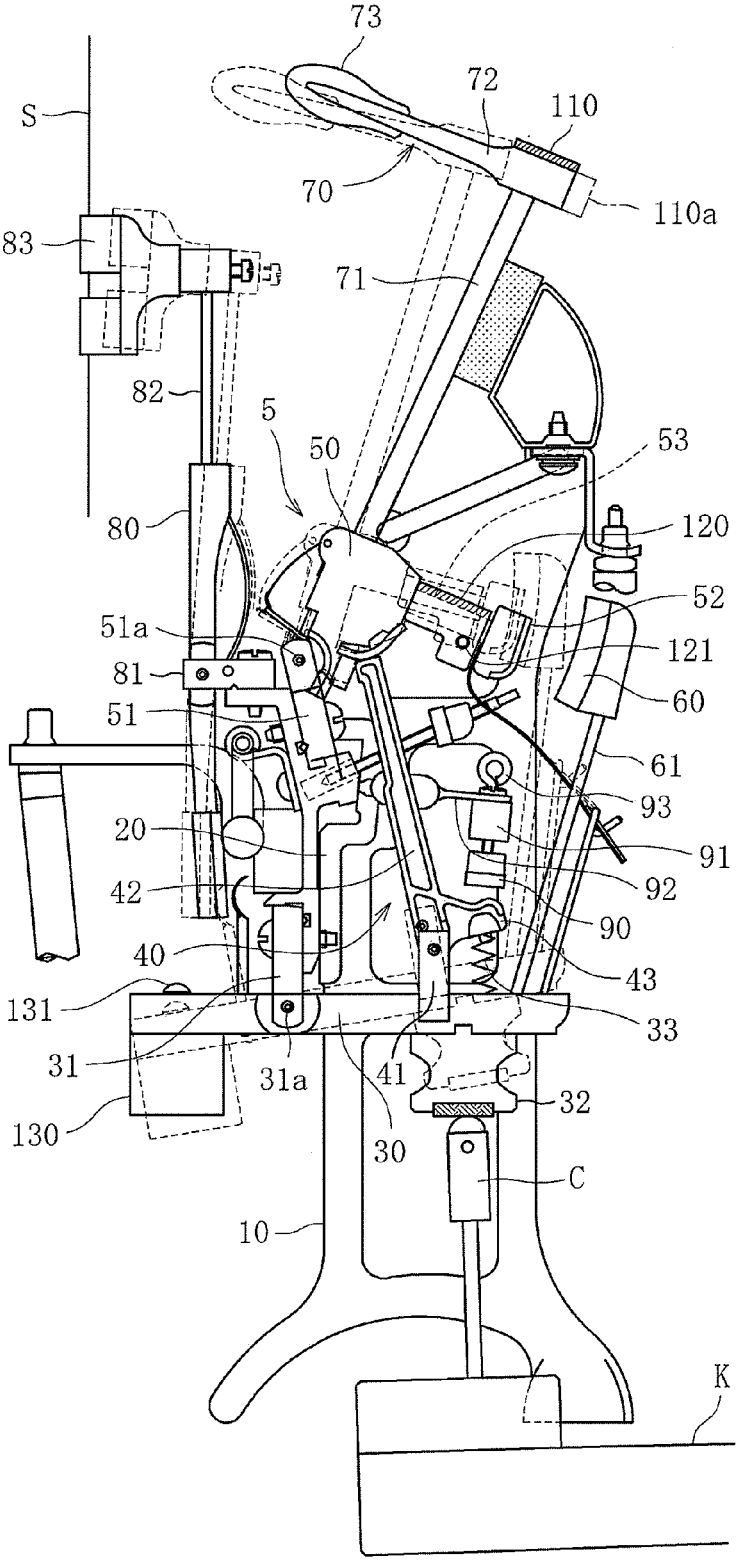
FIG. 2 is a side view indicative of a longitudinal section of the upright piano type action indicated in FIG. 1.

FIG. 1 is a side view of an upright piano type action of the embodiment according to the present invention, along with a keyboard. FIG. 2 is a side view of the action. These figures indicate only parts of the action which serve a treble key. In these figures, solid lines indicate a state in which the key is not being depressed, whereas dashed lines indicate a state in which the key is being depressed, or a string S is being struck.

The shown action is designed for an upright piano which is an acoustic piano. More specifically, the action is designed such that a hammer hits a string S, so that vibrations of the string S are conveyed to a soundboard to generate a musical tone. In a case where an action is designed for an upright-type electronic piano, the string S is replaced with a stopper such as a metal plate, with the hammer being replaced with a swing member that hits the stopper. In this case, more specifically, the electronic piano detects the velocity at which the swing member swings right before the hit so that the electronic piano can generate a musical tone having a tone volume corresponding to the detected velocity.

Hereafter, the present invention will be explained on the basis of an example of the shown action designed for an upright piano. The action has a common fundamental form which will be described below. That is, a center rail 20 extending in the direction of the width of the entire action is supported by brackets 10 which are not shown on the both ends of the center rail 20. On the lower part of the center rail 20, a wippen flange 31 is provided for each key to support a wippen 30 via an axis 31*a* of the wippen flange 31 so that the wippen 30 can swing. The wippen 30 is supported by the wippen flange 31 at the proximity of the rear end of the wippen 30 so that the wippen 30 can extend in the approximately horizontal direction. From the front undersurface of the wippen 30, a wippen heel 32 hangs down so that a capstan button C provided at the proximity of an end of the key will be raised by a depression of the key to lift the wippen heel 32 to swing the wippen 30 upward.

To a part situated at the immediate front of the center of the wippen 30, a jack 40 is coupled via a jack flange 41 so that the jack 40 can swing. The jack 40 is formed of a longer piece 42 and a shorter piece 43 to be shaped like a letter L when seen from the side. The longer piece 42 is inclined slightly rearward to extend upward to be in contact with a butt 5. The shorter piece 43 extends frontward from the lower end of the longer piece 42 so that a compression coil spring 33 inserted between the sorter piece 43 and the wippen 30 can lift the shorter piece 43 upward to urge the jack 40 so that the jack 40 can swing.

On the upper part of the center rail 20, the butt 5 is provided for each key. The butt 5 includes a butt flange 51 and a butt main body 50 supported by the butt flange 51 so that the butt main body 50 can swing about an axis 51*a*. From the upper part of the butt main body 50, a hammer shank (swinging shank) 71 extends. To the tip of the hammer shank 71, a hammer (swinging member) 70 is coupled. To the front part of the butt main body 50, a catcher 52 for restricting recovery of the butt main body 50 from the hitting of the string S is coupled via a catcher shank 53.

To the neighborhood of the front end of the wippen 30, a backcheck wire 61 which extends upward is coupled in order to provide a backcheck 60. The backcheck 60 has a function of restricting recovery of the hammer 70 caused by its repulsion from the hitting of the string S.

The top end of the center rail 20 supports a damper lever 80 provided for each key via a damper lever flange 81 extending backward so that the damper lever 80 can swing. To the damper lever 80, a damper felt 83 is coupled through a damper wire 82 extending upward and the like. In accordance with the swing of the damper lever 80, the damper felt 83 leaves the string S in response to a depression of the key, and comes into contact with the string S in response to a release of the key to stop vibrations of the string S.

Away frontward from the central part, as seen in the vertical direction, of the center rail 20, a regulating rail 91 extends in the width direction of the entire action. The regulating rail 91 is connected to the center rail 20 through regulating brackets 92 spaced one another in the width direction of the entire action. To the regulating rail 91, a regulating screw 93 provided for each key is secured in the vertical direction. To the lower part of the regulating screw 93, a regulating button 90 is fastened. The regulating button 90 has a function of coming into contact with the shorter piece 43 of the jack 40 at some point during the rise of the jack 40 caused by a depression of the key to make the jack 40 swing frontward.

The action operates in response to a depression of the key as follows. In a state where the key is not being depressed, the wippen 30 is located at the lowest position, whereas the jack 40 is situated immediately below the butt main body 50, with the hammer 70 inclining frontward to be supported by a hammer rail. By a depression of the key, the wippen 30 rises, so that the jack 40 makes the butt 50 and the hammer 70 swing. More specifically, the shorter piece 43 is raised until the shorter piece 43 comes into contact with the regulating button 90, so that the jack 40 swings frontward. By the frontward swing, the jack 40 leaves the butt main body 50. Right after the release of the jack 40 from the butt main body 50, the key-depression enters the state of full-stroke. By the release of the jack 40, the hammer 70 enters a state of escapement where the inertia works, so that the hammer 70 hits the string S. After hitting the string S, the hammer 70 recovers rapidly because of the repulsion of the string S, so that the catcher 52 is received by the backcheck 60 to stop the recovery of the hammer 70.

The outline of the fundamental configuration of the action has been described above. Descriptions which are not directly related to the functions of the present invention will be omitted.

Features of the present invention will now be described. FIG. 1 and FIG. 2 indicate an example in which weights are attached to the moving members included in the action as described below. The weight can be attached to one or more of the moving members of a hammer assembly (the assembly formed of the butt, the hammer, the hammer shank, the catcher and the catcher shank).

To the tip of a hammer wood 72 of the hammer 70, a hammer felt 73 is bonded. To the hammer wood 72, a weight 110 can be attached. The weight 110, which is a flat metal piece as indicated in the figures, can be provided on the top surface (the surface which is farther from the hammer shank 71) of the hammer wood 72. Alternatively, a similar weight may be provided on the side surface of the hammer wood 72. As indicated as a weight 110*a*, a weight may be provided on the front end surface (on the end surface situated opposite to the hammer felt 73) of the hammer wood 72. As the means for coupling the weight to the hammer wood, various kinds of means such as bonding and screwing can be employed. Furthermore, the hammer wood 72 may be made of metal or resin of a high specific gravity so that the hammer wood itself can serve as a weight. The hammer 70 can have two or more of these weights. Furthermore, a weight may be provided on the hammer shank 71.

From the butt main body 50, the catcher shank 53 extends frontward (in the direction opposite to the direction in which the hammer hits the string S). To the tip of the catcher shank 53, the catcher 52 is attached. On the catcher shank 53, a weight 120 can be mounted. The weight 120, which is shaped like an inverted letter U in cross section, for example, is attached to the catcher shank 53 such that the catcher shank 53 is covered with the weight 120. Furthermore, a pin 121 is inserted into the lower part of the weight 120 to crimp the edges of the weight 120 to fasten the weight 120 to the catcher shank 53. Alternatively, a weight may be attached to the catcher 52 or the butt main body 50.

The wippen 30 is provided so that the wippen 30 can swing about the axis 31*a* of the wippen flange 31 with respect to the center rail 20. On the undersurface of the wippen 30, a weight 130 can be mounted so that the weight 130 will be situated on the string side of the wippen 30. A through hole penetrates the wippen 30 in the vertical direction so that a screw 131 inserted into the through hole can fasten the weight 130 to the wippen 30.

In the respective cases of the butt main body 50 and the wippen 30, as in the case of the hammer 70, the weights may be attached to various positions. As the coupling means, in addition, various kinds of coupling means can be employed. Furthermore, the butt main body 50 and the wippen 30 may be made of metal or resin of a high specific gravity so that the butt main body and the wippen themselves can serve as a weight, respectively.

By the attachment of the weights, the weights produce inertial resistance at the time of the swinging of the moving members caused by a depression of the key, so that a player perceives the touch having a dynamic weight on a player's finger. The moving members are the hammer 70, the catcher shank 53, or a supporting member extending toward the front and the rear from the butt main body 50. Therefore, the weights are provided at respective positions that are far from the axis 51*a* of the butt 5, resulting in wide areas in which the moving members swing, respectively, in response to the depression of the key. Thus, the attachment of the weights to such members each having a wide swinging area enables production of great inertial forces with small amounts of mass. Without necessity of significant increase in static load of the weights, therefore, the action can produce great dynamic loads to allow the player to perceive the touch which is rich in the feeling of mass.

FIGS. 3 to 8 indicate examples in which later-described moving members of the action are provided with a member (a swing-urging member) for applying urging force in the direction in which the moving member swings at the time of the hitting of the string S. As for the swing-urging member, one or more of the urging members which will be described below can be attached to the action.

Figure 3:
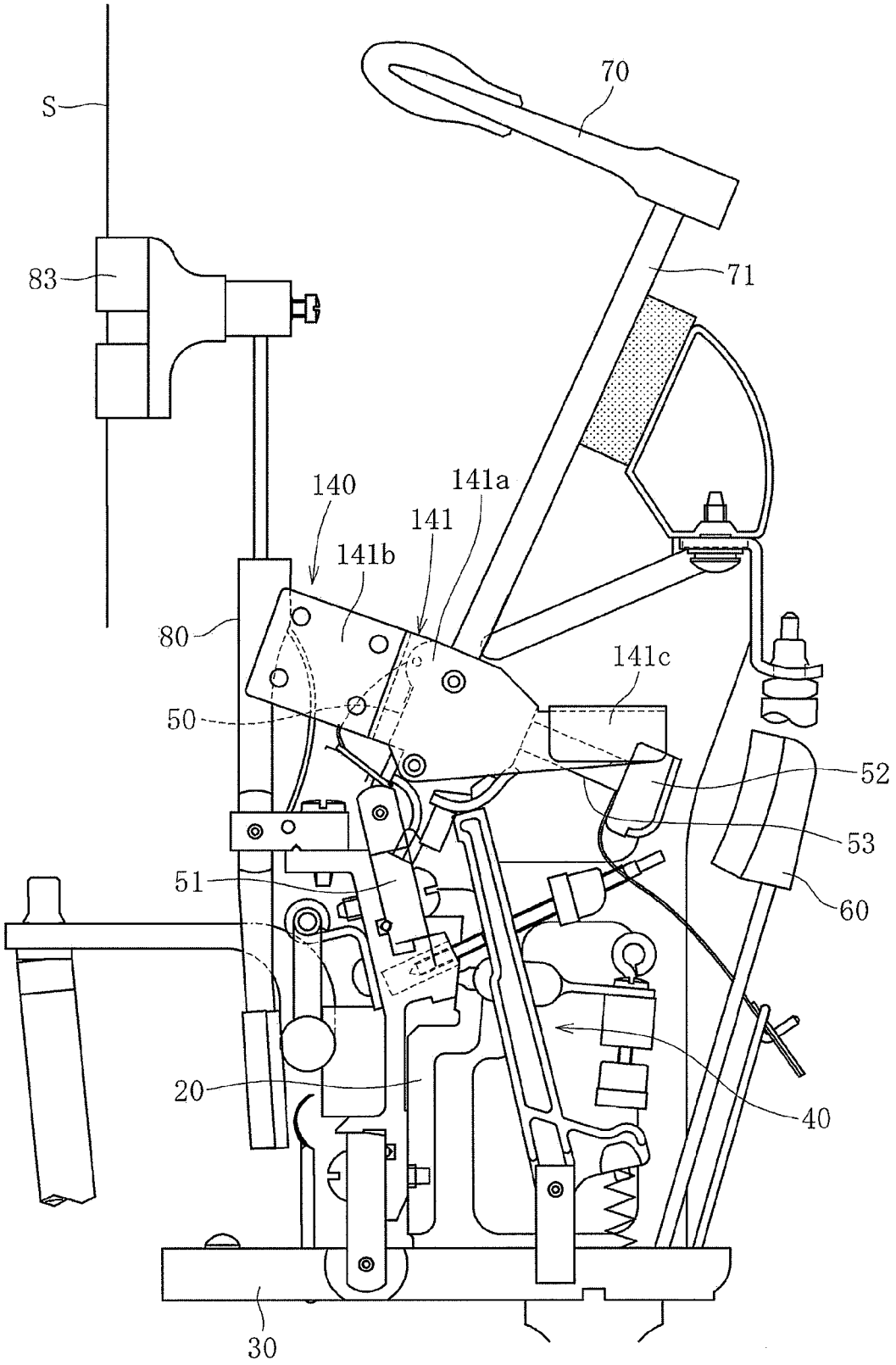
FIG. 3 is a side view indicative of a longitudinal section of an upright piano type action according to another embodiment of the present invention.
Figure 4:
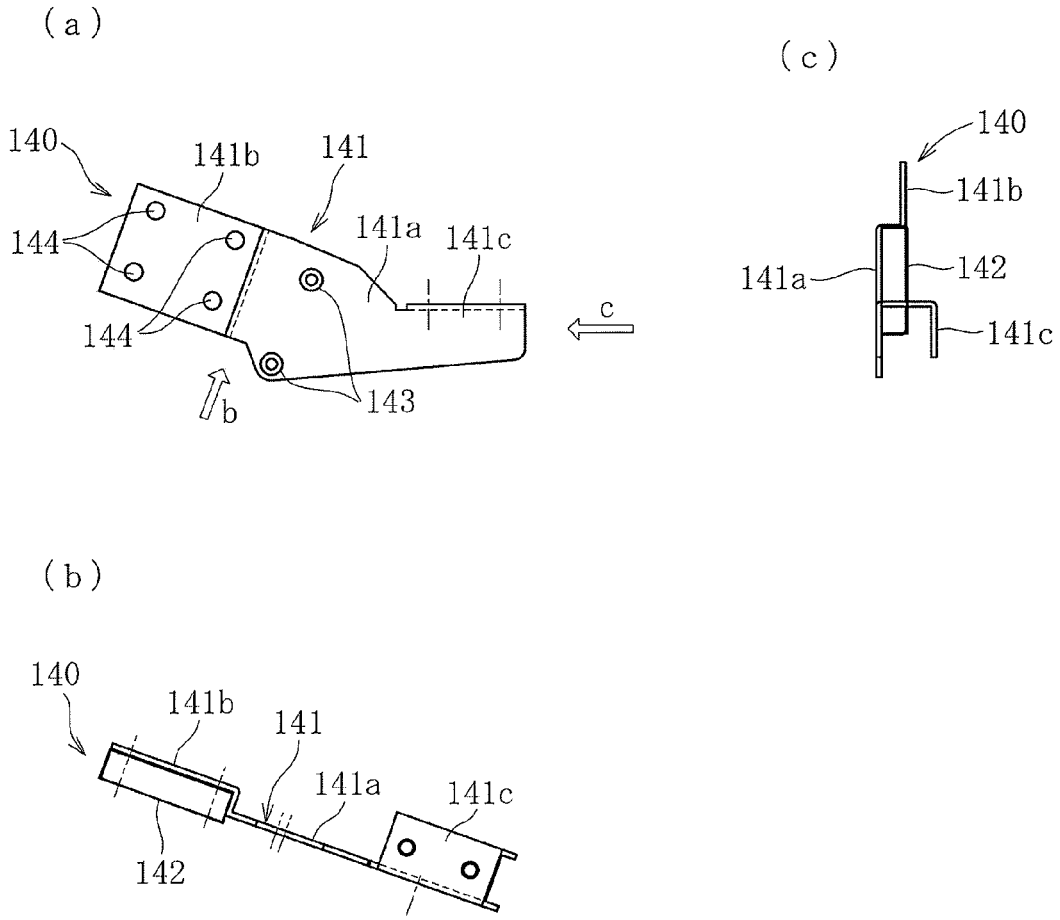
FIG. 4 is drawings indicative of a weight provided on the upright piano type action of FIG. 3, the drawings being seen from various directions.

FIG. 3 indicates an example in which a weight 140 is attached to the butt main body 50 as a swing-urging member. FIG. 4 indicates the weight 140 taken out of FIG. 3. FIG. 4(*a*) is a side view of the weight 140. FIG. 4(*b*) indicates the weight 140 seen from the direction of an arrow b in FIG. 4(*a*), while FIG. 4(*c*) is the weight 140 seen from the direction of an arrow c. The weight 140 includes a supporting member 141 extending toward the front and the rear, and a weight main body 142 supported by the supporting member 141. The supporting member 141, which is shaped like a bent flat plate, includes a flat plate portion 141*a* provided on the butt main body 50, a weight supporting portion 141*b* situated behind the flat plate portion 141*a* (on the side on which the string S is placed), and a position keeping portion 141*c* situated in front of the flat plate portion 141*a* (on the side on which the player is situated).

The flat plate portion 141*a* has two through holes 143, so that the flat plate portion 141*a* is fastened to the butt main body 50 with mounting screws through the holes. The weight supporting portion 141*b* is rectangular, and has four screw holes 144 to fasten the weight main body 142 having almost the same shape as the weight supporting portion 141*b* to the weight supporting portion 141*b* with screws. The weight supporting portion 141*b* extends from the flat plate portion 141*a* with a step which is approximately half the thickness of the weight main body 142. The position keeping portion 141*c* is bent in the width direction of the action at a portion where the flat plate portion 141*a* extends toward the front, and then bent downward (toward the wippen 30) to be shaped like an inverted letter U in cross section. The supporting member 141 is attached to the butt 5 such that the flat plate portion 141*a* is in contact with the butt main body 50 with the catcher shank 53 being covered with the position supporting portion 141*c*.

The urging force exerted by the weight 140 acts in a direction which reduces the hammer assembly's weight and the above-described weights which apply loads in the direction opposite to the swinging direction for hitting. However, the weight 140 weighs an amount that can keep the hammer position of a state where the key is not being depressed, and can also produce a certain amount of key-depression resistance. As described above, the weight 140 acts on the hammer assembly and the like which act in the direction opposite to the hitting direction so that the static loads applied at the time of the key-depression can be reduced. In addition, because the inertial forces of the weight 140 increase in proportion to the acceleration of the swinging weight 140, the action of this example can produce great dynamic loads produced by the weight 140, allowing the player to perceive the touch which is rich in the feeling of mass.

Figure 5:
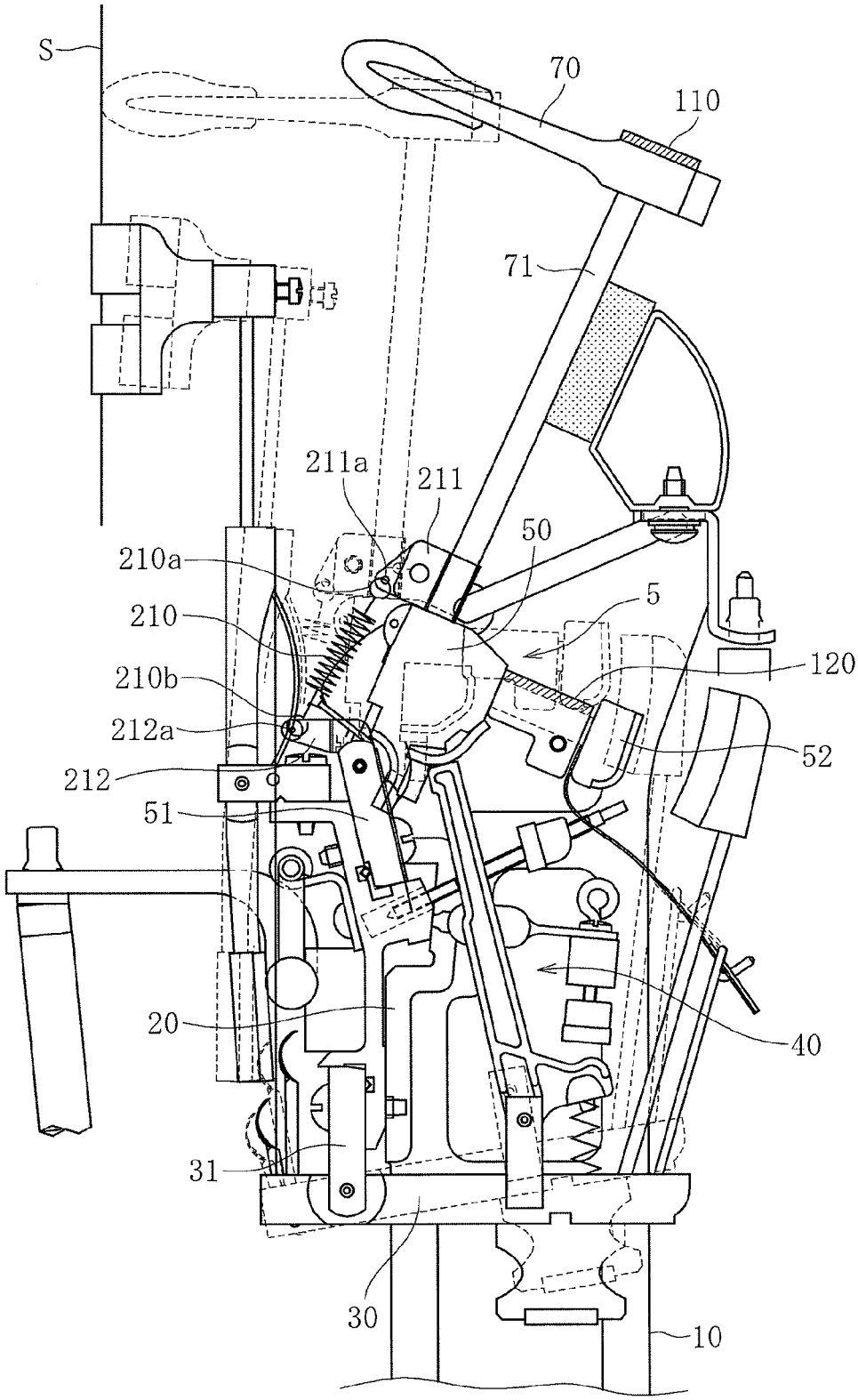
FIG. 5 is a side view indicative of a longitudinal section of an upright piano type action according to still another embodiment of the present invention.

FIG. 5 indicates an example in which a spring 210 is coupled to the hammer shank 71 as a swing-urging member. For this coupling, a first supporting member 211 is provided on the butt's side end of the hammer shank 71, while a second supporting member 212 is provided on the butt flange 51. The first supporting member 211 is a plate-like member which surrounds the hammer shank 71 to protrude rearward. On the protruding edge, a first engaging pin 211*a* is provided. The second supporting member 212 extends rearward (toward the hitting direction) from the neighborhood of the swinging axis on the butt flange 51. On the top end of the second supporting member 212, a second engaging pin 212*a* is provided. The spring 210 is an extension coil spring. More specifically, one hook 210*a* of the spring 210 is engaged in the first engaging pin 211*a*, while the other hook 210*b* is engaged in the second engaging pin 212*a*. As a result, the hammer shank 71 is urged in the hitting direction in which the hammer 70 swings to hit the string S. The spring 210 has an urging force of the magnitude that can keep the hammer position of a state where the key is not being depressed, and can also produce a certain amount of key-depression resistance because of the weight of the hammer assembly and the above-described weights.

As described above, the hammer assembly is provided with the weights such that the loads act, while the key is not being depressed, in the direction opposite to the direction in which the moving members swing for hitting. However, the inertial forces of the weights which act when the key is depressed increase in proportion to the acceleration of the swinging weights. Therefore, the influence caused by the spring 210 is small, so that the spring 210 rarely decreases the inertial forces. As a result, this example enables the spring 210 to reduce the static loads applied by the weights, with the great dynamic loads being produced by the weights, allowing the player to perceive the touch which is rich in the feeling of mass.

At the time of the depression of the key, particularly, the hammer shank 71 swings toward the hitting direction, so that the first engaging pin 211*a* approaches the second engaging pin 212*a* to shorten the length of the spring 210 to reduce the extension force (urging force) of the spring 210. At the early stage of the key-depression, therefore, the spring 210 applies the largest urging force in the direction in which the static loads of the weights are canceled, whereas the urging force of the spring 210 decreases with the progression of the key-depression. The static loads exerted by the weights at the time of the key-depression are the largest at the early stage of the key-depression at which the hammer assembly is inclined forward (toward the player's side) most steeply, whereas the static loads decrease with the progression of the swing of the hammer assembly. Therefore, the urging force of the spring 210 effectively reduces the static loads increased by the addition of the weights.

Additionally, the butt main body 50 might be urged in the hitting direction in which the hammer 70 swings to hit the string S by the spring 210. In this case, the hook 210*a* of the spring 210 is engaged in an upper and rear portion of the butt main body 50.

Figure 6:
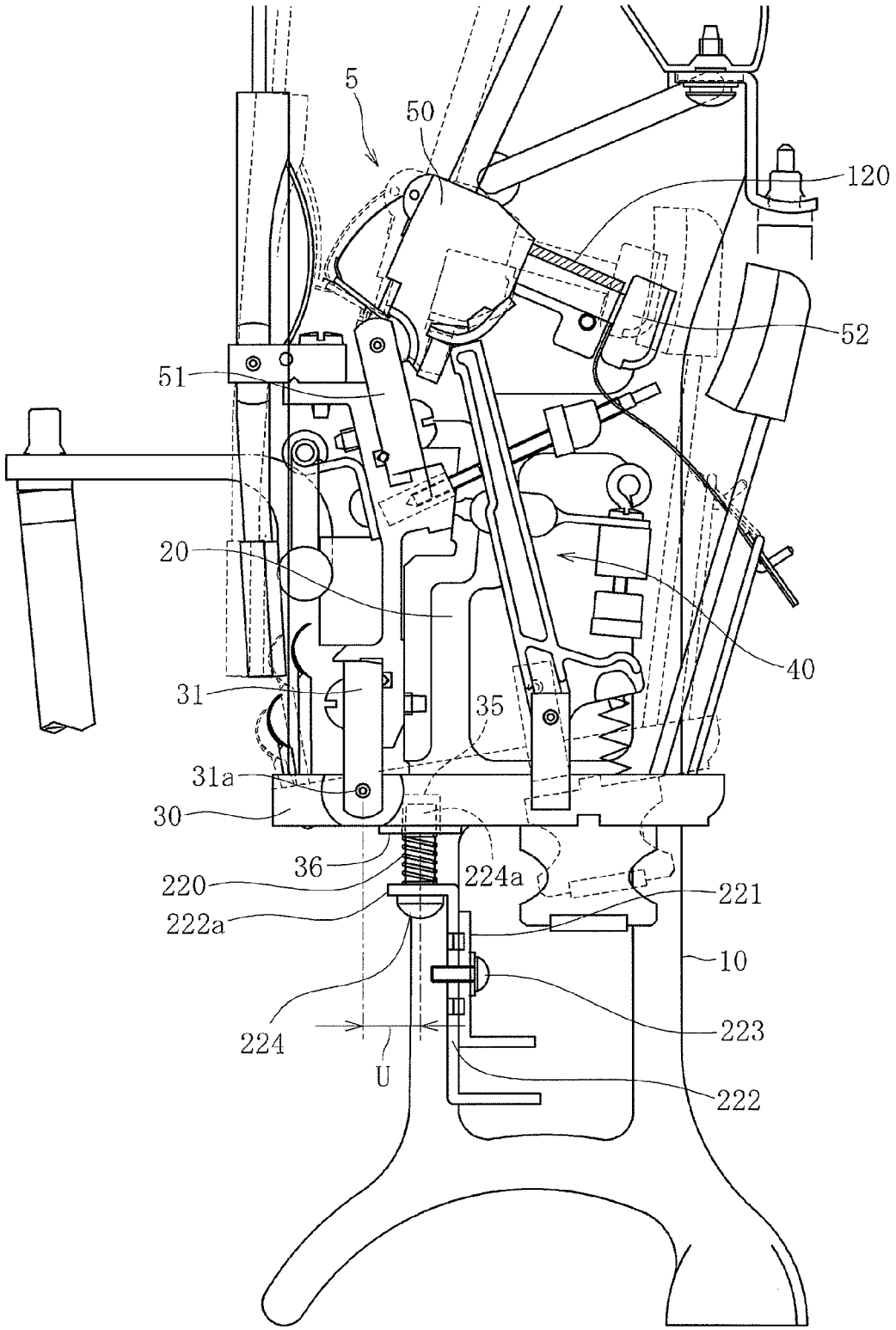
FIG. 6 is a side view indicative of a longitudinal section of an upright piano type action according to a further embodiment of the present invention.

FIG. 6 indicates an example in which a spring 220 is coupled to the wippen 30 as a swing-urging member. For this coupling, a supporting plate 221 spanning between respective lower parts of the brackets 10 and extending in the direction of the width of the action is provided. To the supporting plate 221, a supporting member 222 is fastened for each key with a screw 223. The supporting member 222 is designed such that the top end is bent to be approximately horizontal to serve as a supporting portion 222*a* while the supporting portion 222*a* has an internal thread hole so that a screw 224 can be inserted into the thread hole from the bottom upward. On the undersurface of the wippen 30, a concave portion 35 is provided to loosely accept the screw 224, with a washer 36 being coupled to the undersurface of the wippen 30 to cover the concave portion 35. The top end of the screw 224 is inserted into the concave portion 35, while the spring 220 is provided around a portion of the screw 224 situated between the supporting portion 222*a* and the washer 36. The spring 220, which is a compression coil spring, is designed such that one end of the spring 220 is supported by the bracket 10 through the supporting member 222 and the supporting plate 221, with the other end pressing up the wippen 30 through the washer 36. As a result, the wippen 30 is urged in the direction in which the wippen 30 swings toward the hitting direction. The spring 220 has an urging force of the magnitude that can keep the hammer position of the state where the key is not being depressed, and produce a certain amount of key-depression resistance because of the respective weights of the wippen 30, the jack 40, the hammer assembly and the like, and the above-described weights.

This example can also reduce the static loads of the weights acting on the hammer assembly, with great dynamic loads being produced by the weights, allowing the player to perceive the touch which is rich in the feeling of mass. At the time of the depression of the key, furthermore, the wippen 30 swings toward the hitting direction, so that the distance between the washer 36 and the supporting portion 222*a* increases to increase the length of the spring 220 to reduce the compression force (urging force) of the spring 220. At the early stage of the key-depression, therefore, the spring 220 applies the largest urging force in the direction in which the static loads of the weights are canceled, whereas the urging force of the spring 220 decreases with the progression of the key-depression. The static loads exerted by the weights at the time of the key-depression are the largest at the early stage of the key-depression at which the hammer assembly is inclined forward (toward the player's side) most steeply, whereas the static loads decrease with the progression of the swing. Therefore, the urging force of the spring 220 effectively reduces the static loads increased by the addition of the weights.

It is preferable that the spring 220 is placed such that a distance U from the swinging axis 31*a* of the wippen 30 is comparatively short. Such positioning strengthens the tendency that the action of the spring 220 decreases with the progression of the swing starting at the initial stage of the key-depression. This tendency coincides with the tendency that the static loads applied by the weights decrease with the progression of the key-depression. Therefore, this example can make better use of the action of the dynamic loads exerted by the weights. If the distance U is too long, the action of the spring which decreases with the progression of the key-depression cannot be adequately achieved. If the distance U is too short, a spring having an extremely high spring constant is needed, ending up difficult fine tuning. The supporting member 222 may be replaced with a supporting member having a width which covers a plurality of keys so that the spring 220 will be provided for each key.

Figure 7:
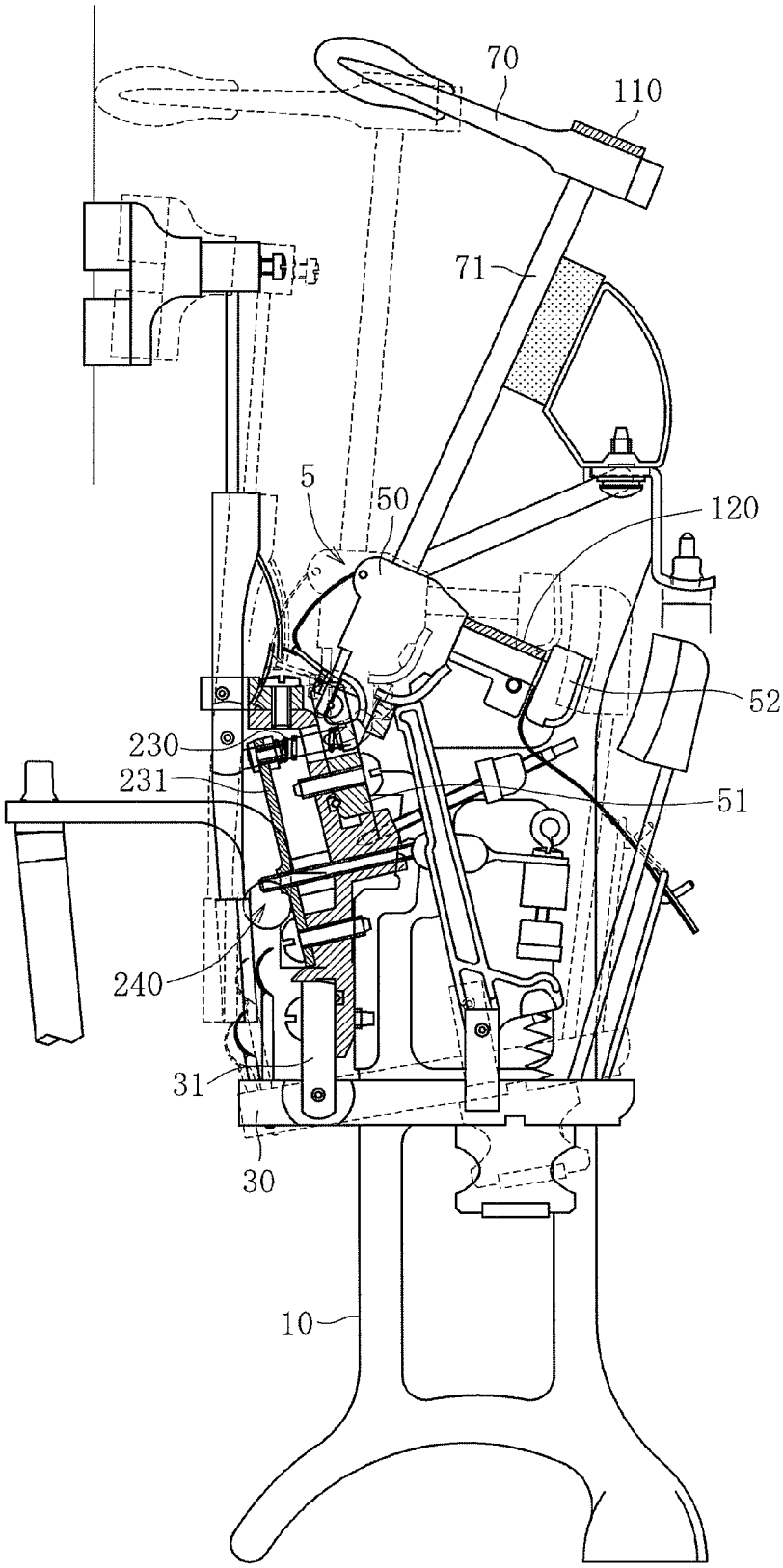
FIG. 7 is a side view indicative of a longitudinal section of an upright piano type action according to still further embodiment of the present invention.
Figure 8:
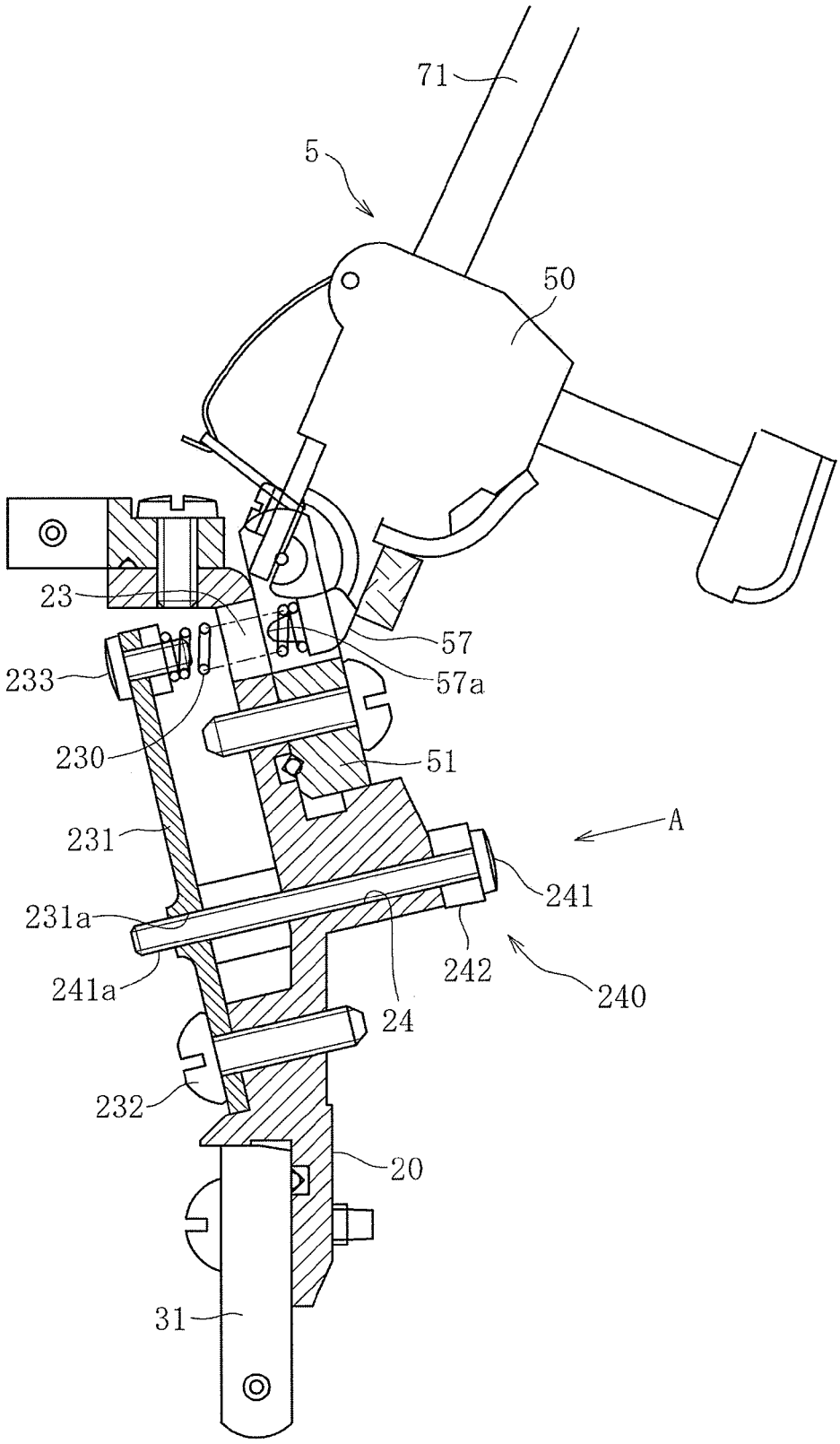
FIG. 8 is a side view indicative of a longitudinal section mainly indicative of an urging member and its coupling structure in the action shown in FIG. 7.

FIG. 7 indicates an example of an action in which a spring 230 is coupled to the butt main body 50 as a swing-urging member. FIG. 8 mainly indicates the spring 230 and its coupling structure in the action shown in FIG. 7. For the coupling between the spring 230 and the butt main body 50, the center rail 20 is provided with a supporting lever 231 (supporting member) for each key. The supporting lever 231, which is a rodlike member extending vertically and being placed on the side opposite to the butt flange 51 on the center rail 20, is elastically deformable but has high stiffness. The lower end (of the wippen's side) of the supporting lever 231 is fastened to the lower part of the center rail 20 with a screw 232. On the upper part of the center rail 20, a through hole 23 is provided, while the top end (free end) of the supporting lever 231 reaches a position accessible to the through hole 23, and has a small screw 233 inserted into a penetrating hole. The lower end of the butt main body 50 serves as a lower protruding portion 57 which protrudes downward from the swing axis 51*a*. The lower protruding portion 57 is placed to be accessible to the through hole 23 on the side opposite to the top end of the supporting lever 231. Between the small screw 233 provided on the top end of the supporting lever 231 and the lower protruding portion 57, the spring 230 is held. The spring 230, which is a compression coil spring, is designed such that one end of the spring 230 is engaged with the small screw 233, with the other end being engaged with a protrusion 57*a* provided on the lower protruding portion 57 to press the lower protruding portion 57 in a direction in which the lower protruding portion 57 moves away from the center rail 20. As a result, the butt main body 50 is urged in the direction in which the butt main body 50 swings toward the hitting direction.

In this embodiment, the action further includes an urging force adjustment mechanism 240. The urging force adjustment mechanism 240 is designed such that into a through hole 24 provided on the center rail 20 and an internal thread hole 231*a* provided on the supporting lever 231, a long adjustment screw 241 is inserted. The adjustment screw 241 is supported by a holding piece 242 secured to the center rail 20 so that the adjustment screw 241 can turn without changing the position in the axis line direction, with an external thread portion 241*a* provided on the edge being engaged with the internal thread hole 231*a* of the supporting lever 231. By turning the adjustment screw 241, therefore, the supporting lever 231 is elastically deformed by the action of the screw so that the supporting lever 231 can move closer to or away from the center rail 20. Thus, the distance between the small screw 233 of the supporting lever 231 and the lower protruding portion 57 of the butt main body 50 can be changed to adjust the urging force exerted by the spring 230 on the lower protruding portion 57. As indicated by an arrow A in FIG. 8, the adjustment is performed at the front (on the player's side) of the action, resulting in improved workability. In order to allow the adjustment, the supporting lever 231 is designed to have an elastic modulus (stiffness) which is higher than that of the spring 230.

This example can also reduce the static loads of the weights acting on the hammer assembly, with the great dynamic loads being produced by the weights, allowing the player to perceive the touch which is rich in the feeling of mass. At the time of the depression of the key, furthermore, the butt main body 50 swings toward the hitting direction, so that the distance between the small screw 233 and the lower protruding portion 57 increases to increase the length of the spring 230 to reduce the compression force (urging force) of the spring 230. At the early stage of the key-depression, therefore, the spring 230 applies the largest urging force in the direction in which the static loads of the weights are canceled, whereas the urging force of the spring 230 decreases with the progression of the key-depression. Therefore, the urging force of the spring 230 effectively reduces the static loads increased by the addition of the weights. The supporting lever 231 may be replaced with a supporting member having a width which covers a plurality of keys so that the spring 230 will be provided for each key.

The present invention is not limited to the above-described embodiments, but may be variously modified without departing from the gist of the invention. In a case of an action of an upright-type electronic piano, for instance, the supporting member 212 of the spring 210 of the action indicated in FIG. 5 may also serve as a shutter for turning on/off a photocoupler for controlling tone generation.

The urging force adjustment mechanism 240 of the action indicated in FIG. 7 and FIG. 8 may be modified such that the adjustment screw 241 is supported so that the adjustment screw 241 can turn without changing the position in the axis line with respect to the supporting lever 231 to change the position in the axis line with respect to the center rail 20. For this modification, an engagement portion for retaining the position of the adjustment screw 241 in the axis direction may be provided on the through hole of the supporting lever 231, with an internal thread hole being provided on the center rail 20 and an external thread portion for engaging with the internal thread hole being provided on the adjustment screw 241.

What is claimed is:

1. An upright piano type action comprising:

a wippen which moves upward and downward in a response to depression and release of a key;

a jack which is supported by the wippen so as to swing;

a butt which is raised by the jack to swing;

a swinging shank which extends from the butt;

a swinging member which is supported by an edge of the swinging shank to perform a hitting activity in accordance with a swing of the butt;

a swing-urging member which is coupled to either the butt or a swinging member which swings in synchronization with the butt to apply an urging force which acts in a swinging direction for hitting;

a catcher shank which extends from the butt;

a catcher which is supported by an edge of the catcher shank such that the catcher is received by a backcheck at the time of recovery from the hitting; and a weight attached to a moving member, the moving member being at least any one of the butt, the swinging shank, the swinging member, the catcher, and the catcher shank, wherein the weight is placed such that, in a state where the key is not being depressed, a load of the weight acts in a direction opposite to the swinging direction of the moving member to which the weight is attached.

2. The upright piano type action according to claim 1, wherein the swing-urging member for applying the urging force is a weight which applies a force produced by a load.

3. The upright piano type action according to claim 2, wherein the weight is attached to the butt.

4. The upright piano type action according to claim 1, wherein the swing-urging member is a spring whose one end is coupled to the butt or the swinging member, with the other end of the spring being coupled to a static member of the action.

5. The upright piano type action according to claim 4, wherein the spring is allowed to adjust the urging force.

6. The upright piano type action according to claim 4, wherein the spring is coupled to the swinging shank.

7. The upright piano type action according to claim 4, wherein the spring is coupled to the wippen.

8. The upright piano type action according to claim 4, wherein the spring is coupled to the butt.

9. The upright piano type action according to claim 4, wherein a spring supporting member is mounted on a center rail which supports the butt such that the butt can swing, the spring supporting member being placed on a side opposite to the butt with respect to the center rail, one end of the spring being coupled to a wippen side's end of the butt such that the spring penetrates a notch of the center rail with the other end of the spring being coupled to the spring supporting member.

10. The upright piano type action according to claim 9, wherein the spring supporting member has a supporting lever which extends from the center rail and whose free end is situated near a swing fulcrum of the butt such that the free end is coupled to the other end of the spring, the supporting lever being coupled to an adjustment screw which extends to penetrate the center rail such that a distance between the free end and the center rail can be changed by the adjustment screw to adjust a spring force which is to act on the butt.

* * * * *